US006772457B1

(12) United States Patent
Alaback

(10) Patent No.: US 6,772,457 B1
(45) Date of Patent: Aug. 10, 2004

(54) BABY CRIB PAD

(76) Inventor: Elizabeth P. Alaback, 4186 S. Zunis Ave., Tulsa, OK (US) 74105

( * ) Notice: Subject to any disclaimer, the term of this patent is extended or adjusted under 35 U.S.C. 154(b) by 246 days.

(21) Appl. No.: 10/210,584

(22) Filed: Jul. 31, 2002

(51) Int. Cl.[7] ..... A47D 15/00
(52) U.S. Cl. ..... 5/93.1; 5/424; 5/663; 5/946
(58) Field of Search ..... 5/93.1, 658, 663, 5/946, 424

(56) References Cited

U.S. PATENT DOCUMENTS

| | | | | |
|---|---|---|---|---|
| 3,018,492 A | * | 1/1962 | Rosen | 5/93.1 |
| 4,215,446 A | | 8/1980 | Mahoney | |
| 4,767,419 A | | 8/1988 | Fattore | |
| 5,241,718 A | * | 9/1993 | Pope | 5/424 |
| 5,437,071 A | | 8/1995 | Feigenbaum | |
| 6,055,690 A | | 5/2000 | Koenig | |
| 6,170,101 B1 | * | 1/2001 | McCloud | 5/424 |
| 6,178,573 B1 | | 1/2001 | Wagner et al. | |
| 6,401,281 B1 | | 6/2002 | Younge | |
| 6,438,775 B1 | * | 8/2002 | Koenig | 5/424 |
| 6,564,403 B1 | * | 5/2003 | Titus | 5/425 |
| 6,681,421 B2 | * | 1/2004 | Carroll | 5/424 |

* cited by examiner

*Primary Examiner*—Michael Trettel
(74) *Attorney, Agent, or Firm*—Molly D. McKay

(57) ABSTRACT

A baby crib pad that consists of a plurality of segments that are attached together on the outside of the baby crib. Each of the individual segments is provided with two or more padded vertical flaps that extend inside the crib between adjacent balusters and are secured around the individual balusters of the crib. Each of the flaps is permanently secured along one side of the flap to its associated segment that is located on the outside of the baby crib and an opposite open side of each of the flaps is provided with a fastener whereby the open side of the flap secures to the segment, thereby forming a padded sleeve that extends around a baluster of the baby crib.

8 Claims, 2 Drawing Sheets

BABY CRIB PAD

BACKGROUND OF THE INVENTION

1. Field of the Invention

The present invention relates to a pad for a baby crib for the purpose of protecting a baby from bumping against the balusters of a baby crib while eliminating the danger of the baby being strangled or suffocated by the pad. More specifically, the present invention is a pad consisting of a plurality of segments that are attached together on the outside of the baby crib and each segment is provided with two or more padded vertical flaps that extend inside the crib between adjacent balusters and are secured around the individual balusters of the crib by fasteners such as hook and loop fasteners.

2. Description of the Related Art

The current advice of most pediatricians is that mothers not use any type of pads in baby cribs because of the threat of the pad becoming wound around the baby's neck and strangling the baby or the threat that the pad could fall over the baby's face and the suffocating the baby. Also, mothers who have both a baby and a toddler worry that the toddler might accidentally dislodge the pad so that the pad falls into the crib on top of the baby.

However, without any type of padding in use on the balusters of a baby crib, babies are in danger of striking their bodies against the balusters and becoming injured. Also, without the use of some type of pad, babies often extend their arms or legs between the balusters where the appendage can become stuck and require an adult to free the appendage.

The present invention addresses these problems by providing a pad that consists of a plurality of segments that are attached together on the outside of the baby crib with fasteners, such as hook and loop fasteners or a tie fasteners, so that if the segments become detached from the baby crib and from adjacent segments, the detached segment will fall outside of the crib where it does not present a danger of strangulation or suffocation to a baby located within the crib.

Each of the individual segments are provided with two or more padded vertical flaps that extend inside the crib between adjacent balusters and are secured around the individual balusters of the crib by fasteners such as hook and loop fasteners. These padded vertical flaps shield the baby from injury from the baby bumping against the balusters of the baby crib. Because each of the flaps is permanently secured along one side of the flap to its associated segment that is located on the outside of the baby crib, if a baby or toddler were able to unfasten one of the flaps on the open side of the flap from its segment, the remaining flaps on the segment would remain fastened around their associated balusters and would prevent the flap from being pulled into the crib a sufficient distance to present a danger of strangulation or suffocation to a baby located within the crib.

Also, if the baby were to unfasten all of the flaps of a segment from around their associated balusters, the segment would be held outside the crib by its attachment to adjacent segments. Because of the location of the segments on the outside of the crib, it would be extremely difficult for a baby located within the crib to separate the segments from each other. On the other hand, if a toddler that was located on the outside of the crib were able to disengage the segments from the crib and from each other, the segments would fall on the outside of the crib where they would not present a danger of strangulation or suffocation to the baby located within the crib.

SUMMARY OF THE INVENTION

The present invention is a baby crib pad that consists of a plurality of segments that are attached together on the outside of the baby crib with tabs that include fasteners, such as hook and loop fasteners, so that if a segments becomes detached from the baby crib and from adjacent segments, the detached segment will fall outside of the crib where it does not present a danger of strangulation or suffocation to a baby located within the crib.

It may be necessary to include at least a couple of segments having an odd number of flaps in order to provide a pad that covers all of the balusters of a baby crib when the baby crib is provided with an odd number of balusters on the sides of the crib. Although the drawings illustrate segments having four flaps, the invention is not so limited and the number of flaps employed can be as low as two. Although the present invention can be made as a single segment for each side of a baby crib, it is desirable to have two or more segments along each side of the crib as this allows better air circulation since air can pass between the segments.

Each of the individual segments are provided with two or more padded vertical flaps that extend inside the crib between adjacent balusters and are secured around the individual balusters of the crib by fasteners such as hook and loop fasteners. Each of the flaps is permanently secured along one side of the flap to its associated segment that is located on the outside of the baby crib and an opposite open side of each of the flaps is provided with a fastener whereby the open side of the flap secures to the segment, thereby forming a padded sleeve that extends around a baluster of the baby crib.

DETAILED DESCRIPTION OF THE PREFERRED EMBODIMENT

Invention

Figure 1:
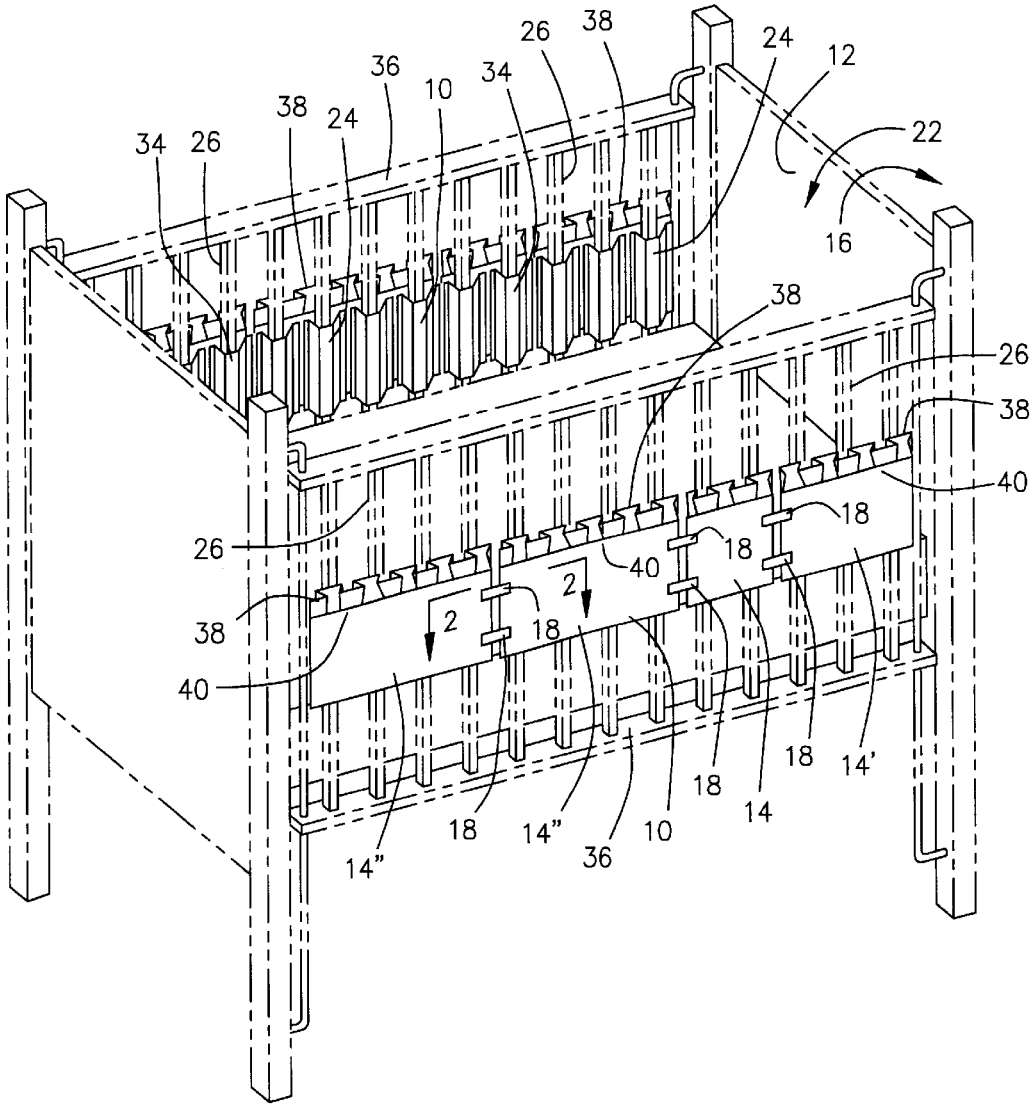
FIG. 1 is a perspective view of a baby crib equipped with a baby crib pad that is constructed in accordance with a preferred embodiment of the present invention.
Figure 2:
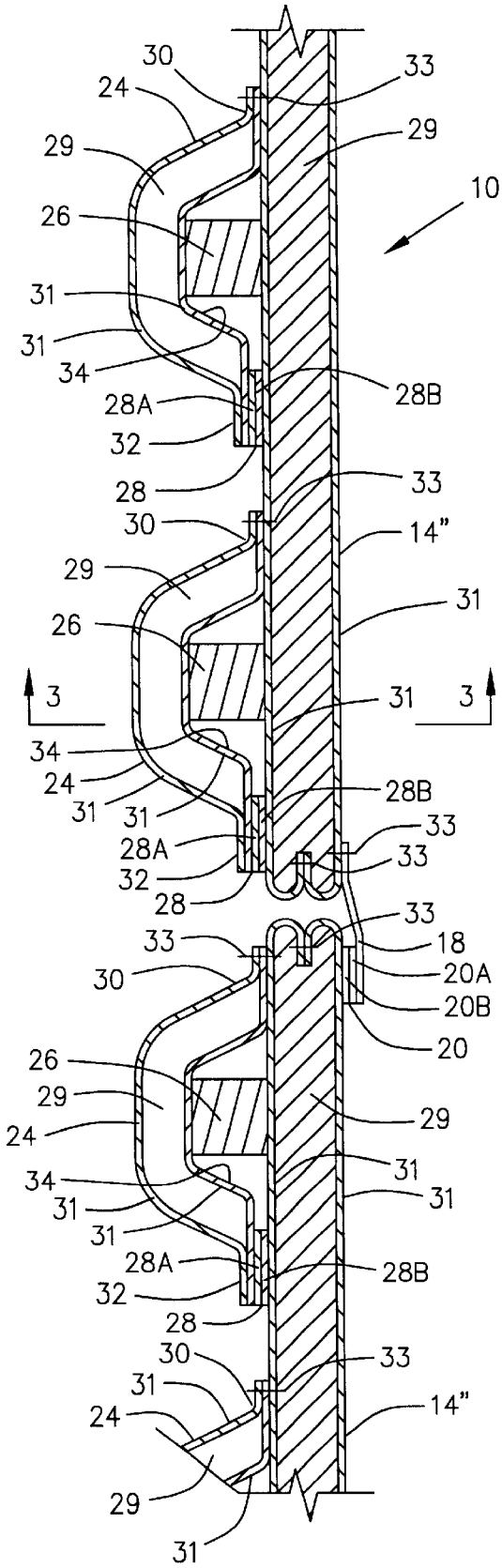
FIG. 2 is a cross sectional view taken along line 2—2 of FIG. 1.

Referring now to the drawings and initially to FIG. 1, there is illustrated a baby crib pad 10 constructed in accordance with a preferred embodiment of the present invention. The pad 10 is shown in use on a baby crib 12. The baby crib pad 10 is formed by a plurality of segments 14 that are attached together on the outside 16 of the baby crib 12. Referring also to FIG. 2, the segments 14 fasten together with tabs 18 that each includes one half 20A of a fastener 20, such as hook and loop fasteners. The other half 20B of the fastener 20 is provided on the adjacent segment 14 so that when the two halves 20A and 20B engage each other, their associated segments 14 are removably secured together.

If a segment 14 becomes detached from the baby crib 12 and from adjacent segments 14, the detached segment 14 will fall on the outside 16 of the crib 12 where it does not present a danger of strangulation or suffocation to a baby located on the inside 22 of the crib 12.

Figure 3:
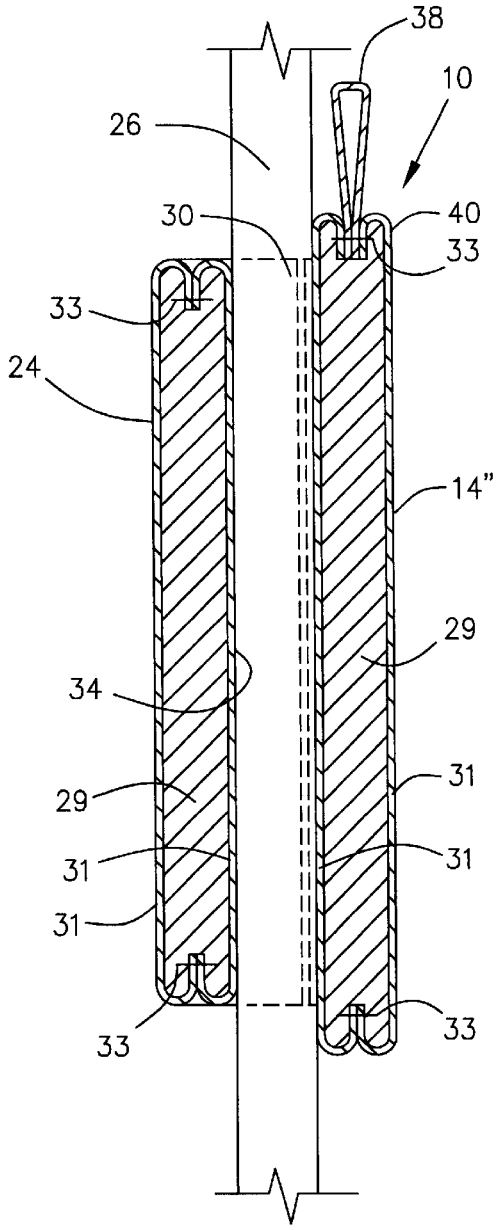
FIG. 3 is a cross sectional view taken along line 3—3 of FIG. 2.

Each of the individual segments 14 is provided with two or more padded vertical flaps 24 that extend between adjacent balusters 26 of the crib 12 to the inside 22 of the crib 12 and are secured around the individual balusters 26 by fasteners 28 such as hook and loop fasteners. FIGS. 2 and 3 show details of the construction of the flaps 24 and the segments 14. Both the flaps 24 and the segments 14 are constructed of padding 29 sandwiched between external layers of material 31, such as for example cloth. The external layers 31 are sewn together at seams 33. Also, the flaps 24 and the tabs 18 are sewn to the segments 14 via seams 33. Each of the flaps 24 is permanently secured along one side 30 of the flap 24 to its associated segment 14 that is located on the outside 16 of the baby crib 12. An opposite open side 32 of each of the flaps 24 is provided with a first half 28A of a fastener 28 whereby the open side 32 of the flap 24 detachably secures to its associated segment 14 via a second half 28B of the fastener 28 provided on the segment 14 when the two halves 28A and 28B engage each other, thereby forming a padded sleeve 34 that extends around a baluster 26 of the baby crib 12.

It may be necessary to include at least a couple of segments 14' having an odd number of flaps 24 in order to provide a pad 10 that covers all of the balusters 26 of a baby crib 12 when the baby crib 12 is provided with an odd number of balusters 26 on the sides 36 of the crib 12. Although FIG. 1 illustrates segments 14, 14' and 14" having two, three, or four flaps 24, respectively, the invention is not so limited and the number of flaps 24 employed can vary. Although the present invention can be made as a single segment 14 for each side 36 of a baby crib 12, it is desirable to have two or more segments 14 along each side 36 of the crib 12 as this allows better air circulation since air can pass between the segments 14.

As illustrated in FIGS. 1 and 3, each of the segments 14 may optionally include ruffles (not illustrated), pleats 38 or other decorative element for decoration, depending on whether the pad 10 will be used for a girl baby, a boy baby, or a child for which the gender is not yet known. As illustrated in FIG. 3, the ruffles or pleats 38 may be sewn to an upper edge 40 of the segments 14 via another seam 33.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A baby crib pad comprising:

at least two segments for attachment on the outside of a baby crib, means for securing the segments together on the outside of the baby crib, at least two padded vertical flaps secured to each segment for extending around a baluster provided on the baby crib, and fastening means provided on an open side of each flap for removably securing the flap around the baluster.

2. A baby crib pad according to claim 1 wherein the means for securing the segments together is a hook and loop fastener.

3. A baby crib pad according to claim 2 wherein the fastening means provided on an open side of each flap is a hook and loop fastener.

4. A baby crib pad according to claim 3 further comprising:

a decorative element attached to each of the segments.

5. A combination baby crib pad and baby crib comprising:

at least two segments attached together outside sides of a baby crib, means for removably securing the segments together, at least two padded vertical flaps secured to each segment, each flap extending around a baluster provided on the sides of the baby crib, and fastening means provided on an open side of each flap for removably securing the open side of the flap to the segment so that the flap extends around its associated baluster.

6. A baby crib pad according to claim 5 wherein the means for removably securing the segments together is a hook and loop fastener.

7. A baby crib pad according to claim 6 wherein the fastening means provided on an open side of each flap is a hook and loop fastener.

8. A baby crib pad according to claim 7 further comprising:

a decorative element attached to each of the segments.

* * * * *